US009358165B2

(12) United States Patent
Wu

(10) Patent No.: US 9,358,165 B2
(45) Date of Patent: Jun. 7, 2016

(54) FRONT SUSPENSION SYSTEM FOR AN ELECTRIC WHEELCHAIR

(71) Applicant: ENERGY CONTROL LIMITED, Tortola (VG)

(72) Inventor: Donald P. H. Wu, Hsinchu County (TW)

(73) Assignee: Energy Control Limited, Road Town (VG)

( * ) Notice: Subject to any disclaimer, the term of this patent is extended or adjusted under 35 U.S.C. 154(b) by 0 days.

(21) Appl. No.: 14/815,485

(22) Filed: Jul. 31, 2015

(65) Prior Publication Data

US 2016/0051425 A1 Feb. 25, 2016

(30) Foreign Application Priority Data

Aug. 20, 2014 (TW) ..... 103128564 A

(51) Int. Cl.
*A61G 5/10* (2006.01)

(52) U.S. Cl.
CPC ..... *A61G 5/10* (2013.01); *A61G 2005/1078* (2013.01); *A61G 2005/1089* (2013.01); *Y10S 180/907* (2013.01)

(58) Field of Classification Search
CPC ..... Y10S 180/907
See application file for complete search history.

(56) References Cited

U.S. PATENT DOCUMENTS

| | | | | |
|---|---|---|---|---|
| 6,554,086 | B1 * | 4/2003 | Goertzen | A61G 5/043 180/65.1 |
| 7,040,429 | B2 * | 5/2006 | Molnar | A61G 5/043 180/65.1 |
| 7,389,835 | B2 * | 6/2008 | Mulhern | A61G 5/042 180/22 |
| 9,010,470 | B2 * | 4/2015 | Cuson | A61G 5/06 180/65.31 |
| 9,072,640 | B2 * | 7/2015 | Wu | A61G 5/06 |
| 2007/0114079 | A1 * | 5/2007 | Chao | A61G 5/042 180/65.1 |
| 2012/0080244 | A1 * | 4/2012 | Hou | A61G 5/043 180/24.07 |
| 2013/0207364 | A1 * | 8/2013 | Bekoscke | A61G 5/045 280/124.104 |
| 2015/0196441 | A1 * | 7/2015 | Mulhern | A61G 5/04 180/170 |

* cited by examiner

*Primary Examiner* — Nicole Verley
(74) *Attorney, Agent, or Firm* — Wang Lang Firm, Inc.

(57) ABSTRACT

A front suspension system for an electric wheelchair includes front pivot shaft, a front wheel retainer, an elasticity resistance member, and a front shock absorber. The front shock absorber is disposed on a horizontal first section of the front wheel retainer so as to improve climbing capability of the wheelchair. The elasticity resistance member is disposed between the frame and the front wheel retainer and has two ends connected to the front wheel retainer and the abutting member of the frame, respectively. When the front wheels encounters bumpy road and makes the front wheel retainer pivot, the elasticity resistance member will be compressed to produce a reaction force toward the front wheel retainer and the abutting member of the frame, respectively, so that the front wheel retainer is pressed down to keep pressing against the flat bearing surface, and the frame is also pressed downward to prevent tipping backward.

5 Claims, 10 Drawing Sheets

FRONT SUSPENSION SYSTEM FOR AN ELECTRIC WHEELCHAIR

CROSS REFERENCE TO RELATED APPLICATION

This application claims the benefit of priority to TW 103128564, filed on Aug. 20, 2014 with the Intellectual Property Office of the Republic of China, Taiwan, the entire specification of which is incorporated herein by reference.

BACKGROUND OF THE INVENTION

1. Field of the Invention

The present invention relates to a suspension system, and more particularly to a front suspension system for an electric wheelchair.

2. Related Prior Art

A suspension system is generally provided with a shock absorbing device and links which are used to reduce the bounce or impact to the vehicle caused by a bumpy road, so as to keep the passengers comfortable.

FIG. 1 shows that an electric wheelchair C1 moves on a bearing surface G, to the front end of a frame C11 of the electric wheelchair C1 are secured two front wheel retainers C12, each of which is provided with a front shock absorber C13, and to the rear end of the frame C11 are secured two rear wheel retainers C14, and each being provided with a rear shock absorber C15. The front and rear shock absorber C13, C15 can slow down the up and down motion of the frame C11, so as to improve riding comfort.

Each of the front wheel retainers C12 consists of a first section C121 and a second section C122 coupled to the first section C121, the first section C121 is disposed at an angle of approximately 30 degrees with respect to the bearing surface G, and the second section C122 is parallel to the bearing surface G. The first section C121 has one end pivoted to the frame C11 and another end coupled to one end of the second section C122 which has another end provided with a front wheel C16. Each of the front shock absorbers C13 has one end pivoted to a corresponding one of the first section C121. When the front wheels C16 of the electric wheelchair C1 encounters a raised obstacle, the front wheel retainers C12 will pivot upward to make the front wheels C16 climb over the obstacle.

Therefore, the climbing capability of the electric wheelchair C1 is determined by pivoting capability of the front wheel retainers C12. The higher the pivoting of the front wheel retainers C12, the bigger the climbing capability of the electric wheelchair C1, and the greater the shock absorbing performance against bumpy road will be.

However, the end of the front wheel retainers C12 pivoted to the frame C11 is also restricted by the front shock absorber C13 (for easy explanation, only one set of front wheel and its relative components are described), the pivoting angle of the front wheel retainer C12 is closely linked with the structure arrangement of the front wheel retainer C12 and the location of the front shock absorber C13. Since the front wheel retainer C12 is pivoted to the first section C121 of the front wheel retainer C12, and the first section C121 is located adjacent to the front shock absorber C13 and inclined towards the bearing surface G, the initial position of the pivoting of the front wheel retainer C12 is the angle position of the first section C121, and the finish position of the pivoting is the position of the front shock absorber C13, namely, the pivoting angle of the front wheel retainer C12 is restricted between the front shock absorber C13 and the first section C121. The arrangement of the first section C121 being inclined towards and located adjacent to the front shock absorber C13 substantially narrows the pivoting capability of the front wheel retainer C12, and as a result, the climbing capability of the electric wheelchair C1 climbing over the obstacles is limited.

Referring then to FIG. 2, another conventional electric wheelchair C2 is provided with a front wheel retainer C22 and a rear wheel retainer C23 which are fixed to the front and rear ends of a frame C21 of the wheelchair C2, respectively, for mounting of a front wheel C24 and a rear wheel C25, respectively. The front suspension system of the frame C2 includes the front wheel retainer C22 and a spring C26 which is perpendicularly disposed on the front wheel retainer C22.

With the elasticity of the spring C26, the front wheel retainer C22 can move up and down along with the front wheel C24 to absorb the bounce caused by bumpy road. When the wheelchair moves on a flat and smooth or a little bumpy road, the direction in which the front wheel retainer C22 presses the spring C26 is the same as the direction that the spring C26 are compressed, the spring C26 is in the best condition for damping and shock absorbing.

When moving on a very bumpy road, the front wheel C24 bounces up and down and causes movement of the front wheel retainer C22, the front wheel retainer C22 will press against the spring C26 in an inclined manner. Therefore, the front wheel retainer C22 presses laterally against the spring C26, namely, the direction in which the press force is applied by the front wheel retainer C22 is different from the direction that the spring C26 is compressed, which will cause bending of the spring C26, and the damping effect is adversely affected. Besides, the more bumpy the road is, the greater the upward pressing force applied to the front wheel retainer C22 will be. When the upward pressing force applied to the front wheel retainer C22 is big, and the elastic force of the spring C26 is the only force to counteract the upward pressing force, once the elastic force of the spring C26 is not big enough to counteract the upward pressing force, the frame C2 of the wheelchair will tip backward, and as a result, the wheelchair won't be able to move safely on the bumpy road.

The present invention has arisen to mitigate and/or obviate the afore-described disadvantages.

SUMMARY

The present invention is aimed at providing a front suspension system for an electric wheelchair, which is capable of preventing the frame of the wheelchair from tipping over when moving on a bumpy road.

To achieve the above objective, a front suspension system for an electric wheelchair in accordance with the present invention is assembled onto a frame of the electric wheelchair and provided for mounting of two front wheels which are disposed at one end of the frame, at another end of the frame are provided two rear wheels. To each of two sides between the two ends of the frame being pivotally fixed one end of an assembling frame via a pivot, the front suspension system includes a front pivot shaft, a front wheel retainer, an elasticity resistance member, and a front shock absorber. The front pivot shaft has one end fixed to the frame, and the front wheel retainer has two ends fixed to the front pivot shaft and the front wheels, respectively. The front suspension system is characterized in that:

an abutting member is on the frame;

a surface of the front wheel retainer facing the frame is formed with a driving portion, the front wheel retainer includes a first section, a second section, and a third section which are connected sequentially with one another, an extending direction of the first section is defined as a second direction which is perpendicular to a first direction, an extending direction of the second section defines an angle with respect to the first and second direction, respectively;

the elasticity resistance member is disposed between the frame and the front wheels retainer and is sequentially provided with a driving section, an elasticity resistance section and a stop section, the elasticity resistance section is a spiral structure, and the driving section and the stop section are connected to two ends of the elasticity resistance section, respectively, and extend in two different directions, the elasticity resistance member is sleeved onto the front pivot shaft, the driving section of the elasticity resistance member is connected to the driving portion of the front wheel retainer, and the stop section is stopped against the abutting member; and the front shock absorber has one end pivoted to the first section of the front wheel retainer, and has another end pivoted to another end of the assembling frame, an axis of the front shock absorber is located at angle ranging from 0-10 degrees with respect to the first direction, and the another end of the front shock absorber fixed to the assembling frame is inclined towards the rear wheels.

Arranging the front shock absorber on the horizontal first section can improve upward pivoting capability of the front wheel retainer, which consequently increases the climbing capability of the wheelchair. Besides, the elasticity resistance member is disposed between the frame and the front wheel retainer and has two ends connected to the front wheel retainer and the abutting member of the frame, respectively. When the front wheels encounters bumpy road and makes the front wheel retainer pivot, the elasticity resistance member will be compressed to produce a reaction force toward the front wheel retainer and the abutting member of the frame, respectively, so that the front wheel retainer is pressed down to keep pressing against the flat bearing surface, and the frame is also pressed downward to prevent tipping backward.

DETAILED DESCRIPTION

Figure 1:
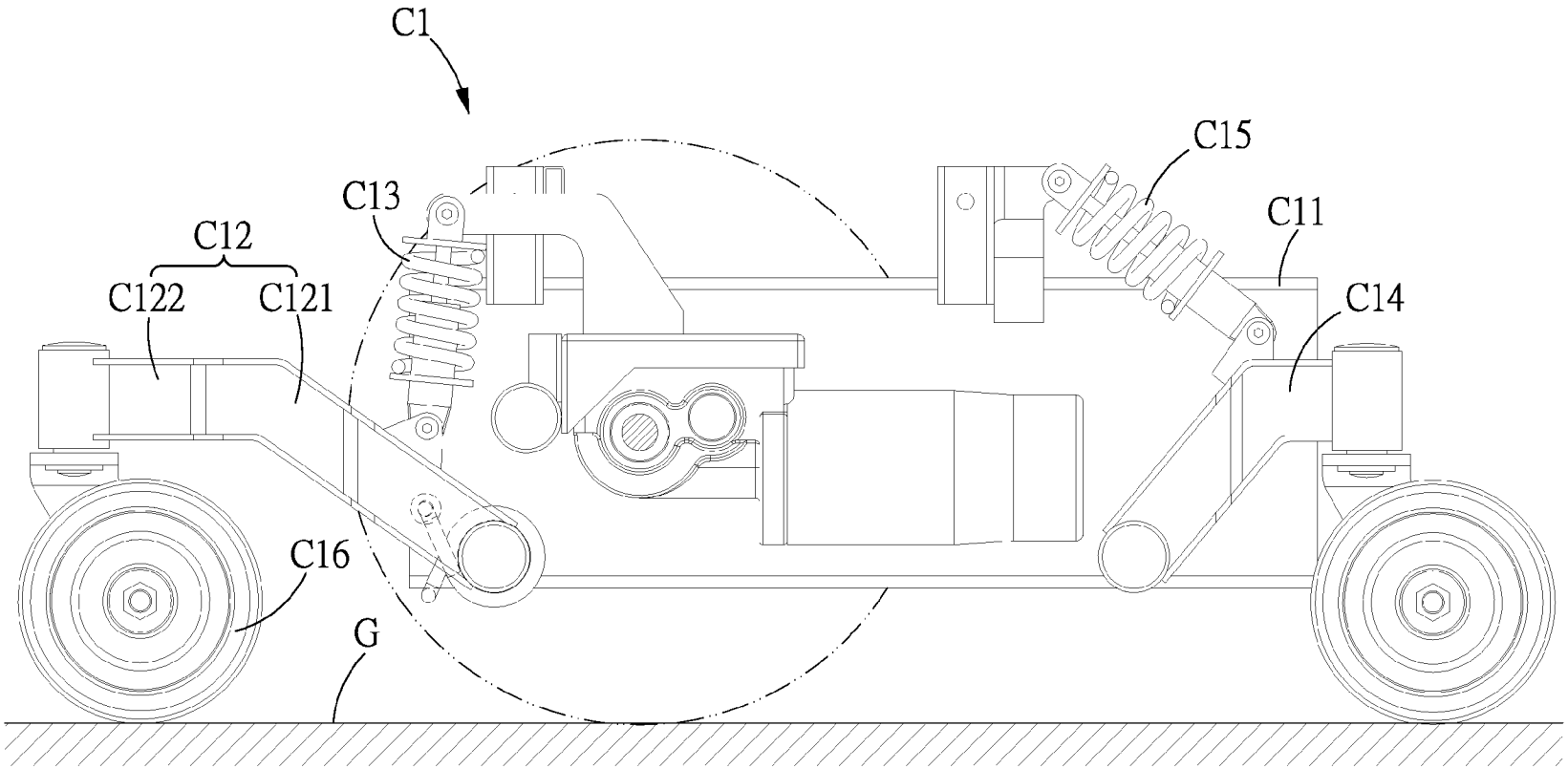
FIG.1 PRIOR ART
FIG. 1 is an illustrative view of a frame of a conventional electric wheelchair.
Figure 2:
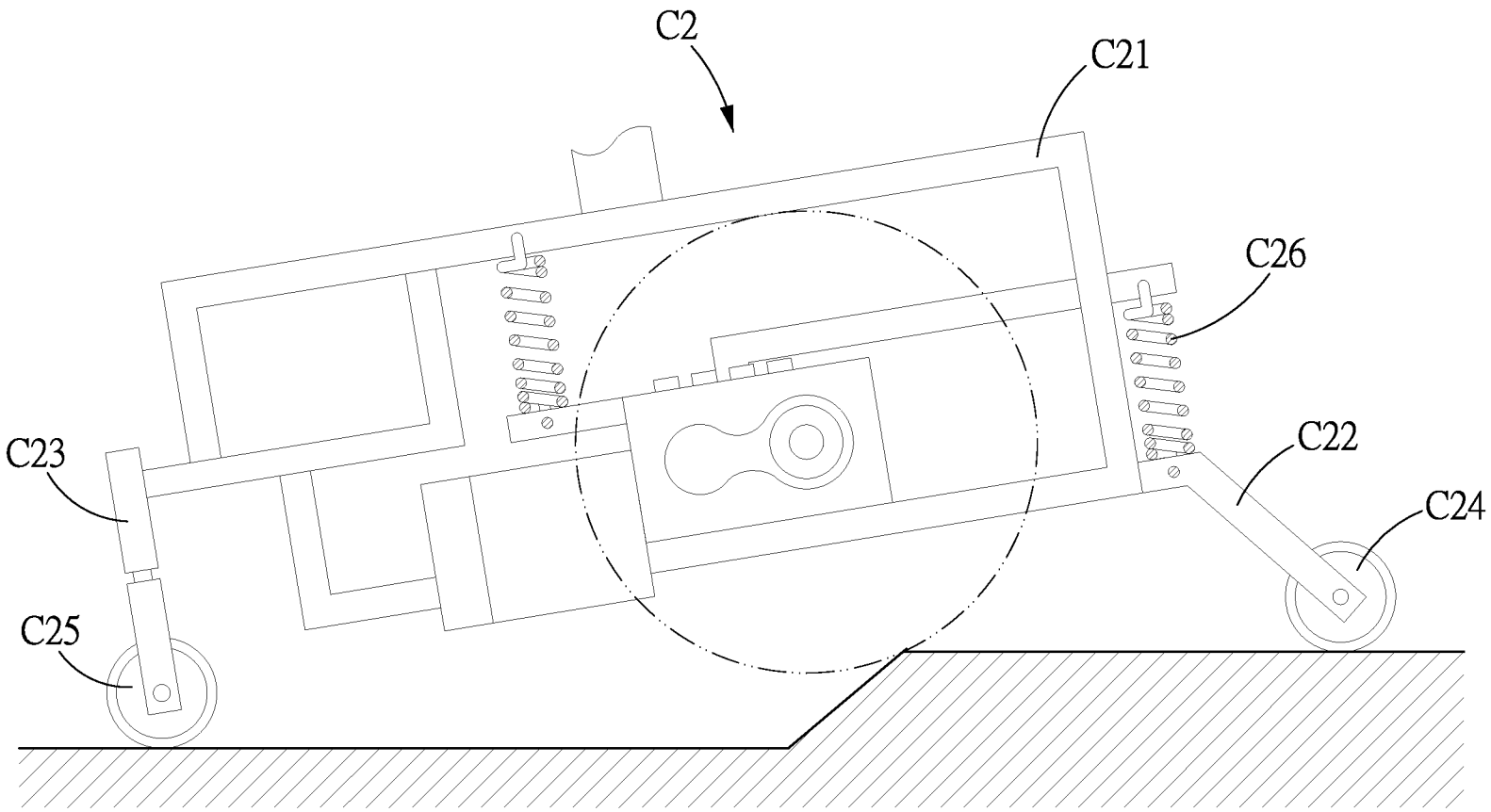
FIG.2 PRIOR ART
FIG. 2 is an illustrative view of a frame of another conventional electric wheelchair.
Figure 3:
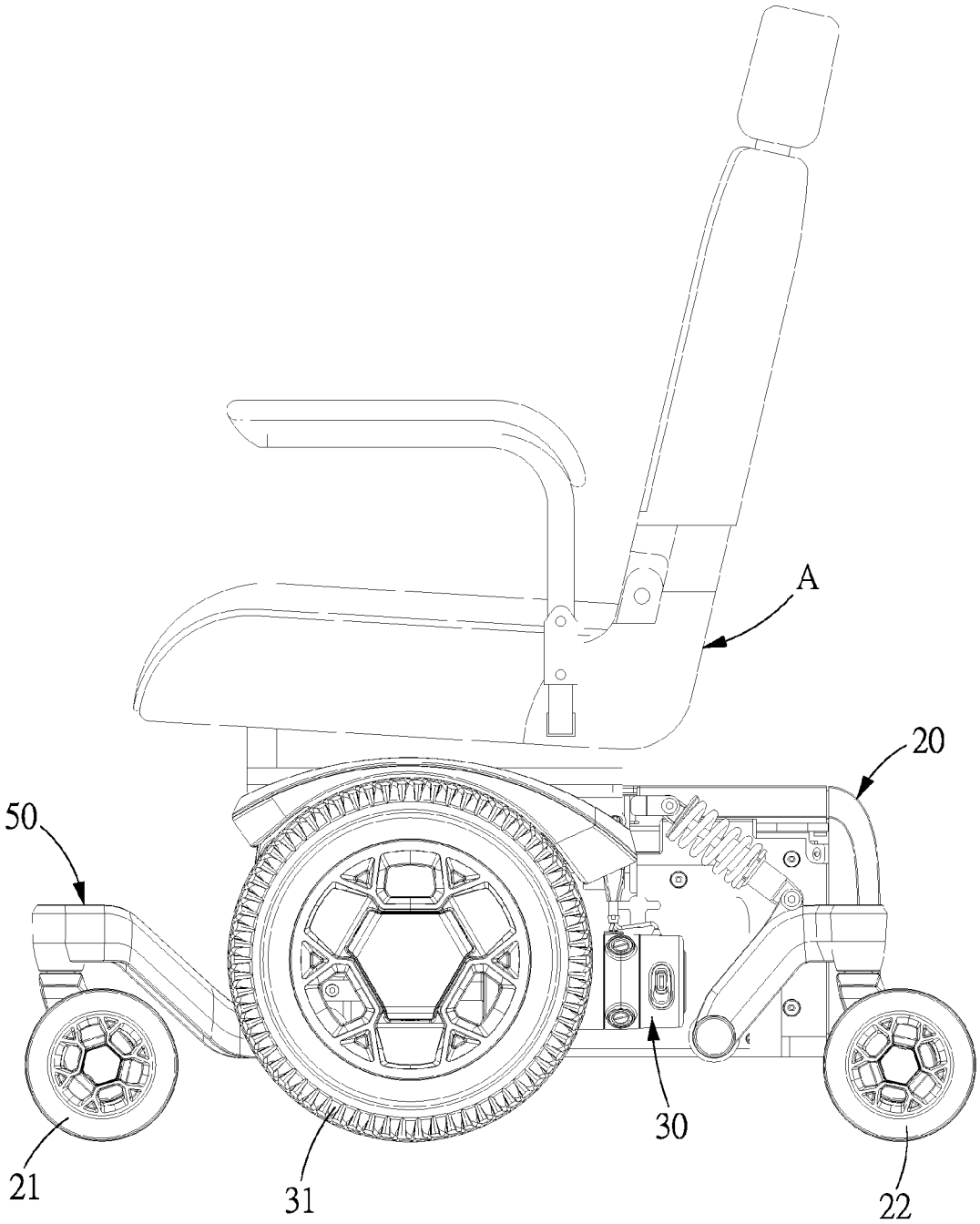
FIG. 3 is an operational view of a front suspension system for an electric wheelchair in accordance with a preferred embodiment of the present invention.
Figure 4:
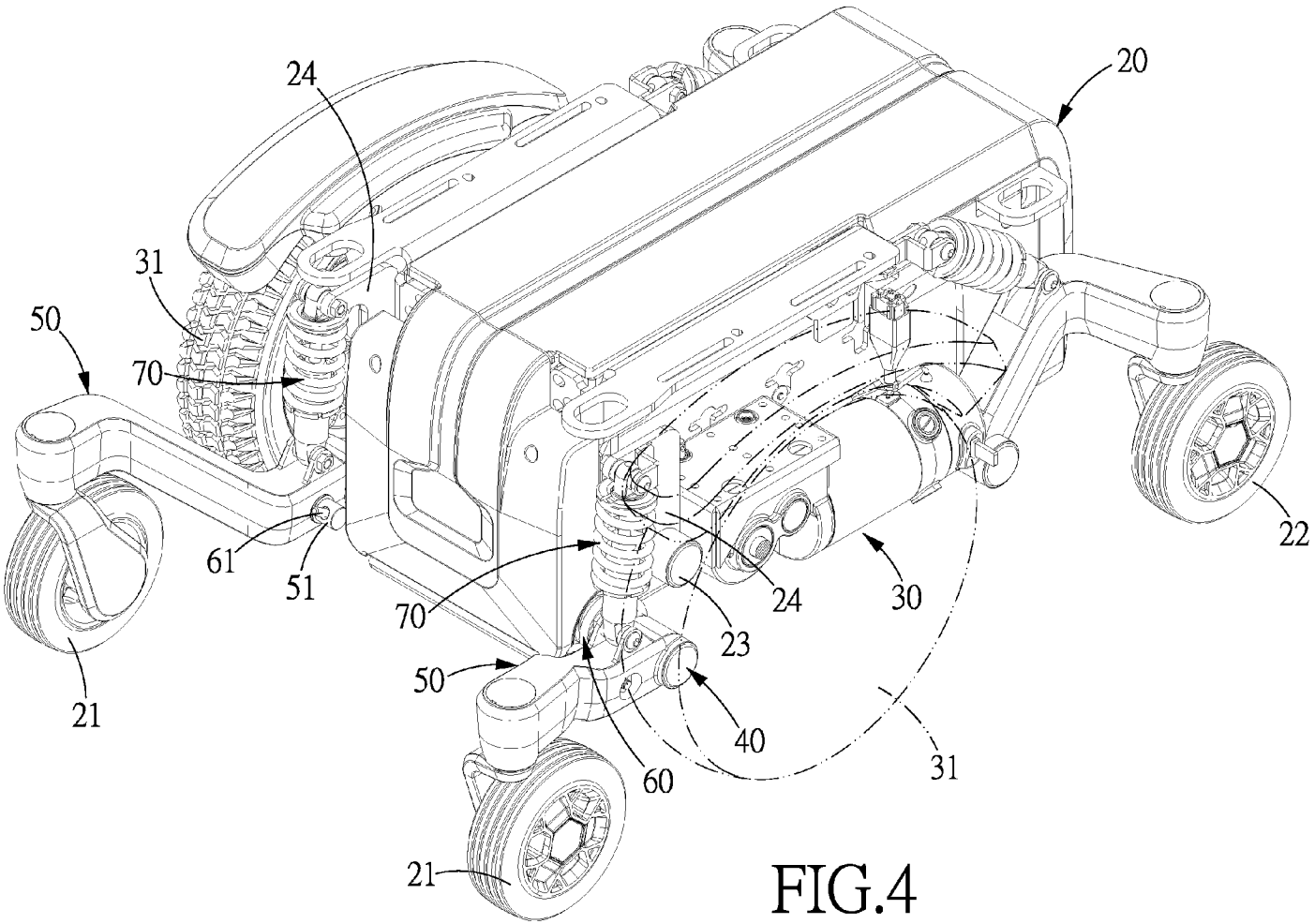
FIG. 4 is a perspective view of the front suspension system for an electric wheelchair in accordance with the preferred embodiment of the present invention.
Figure 5:
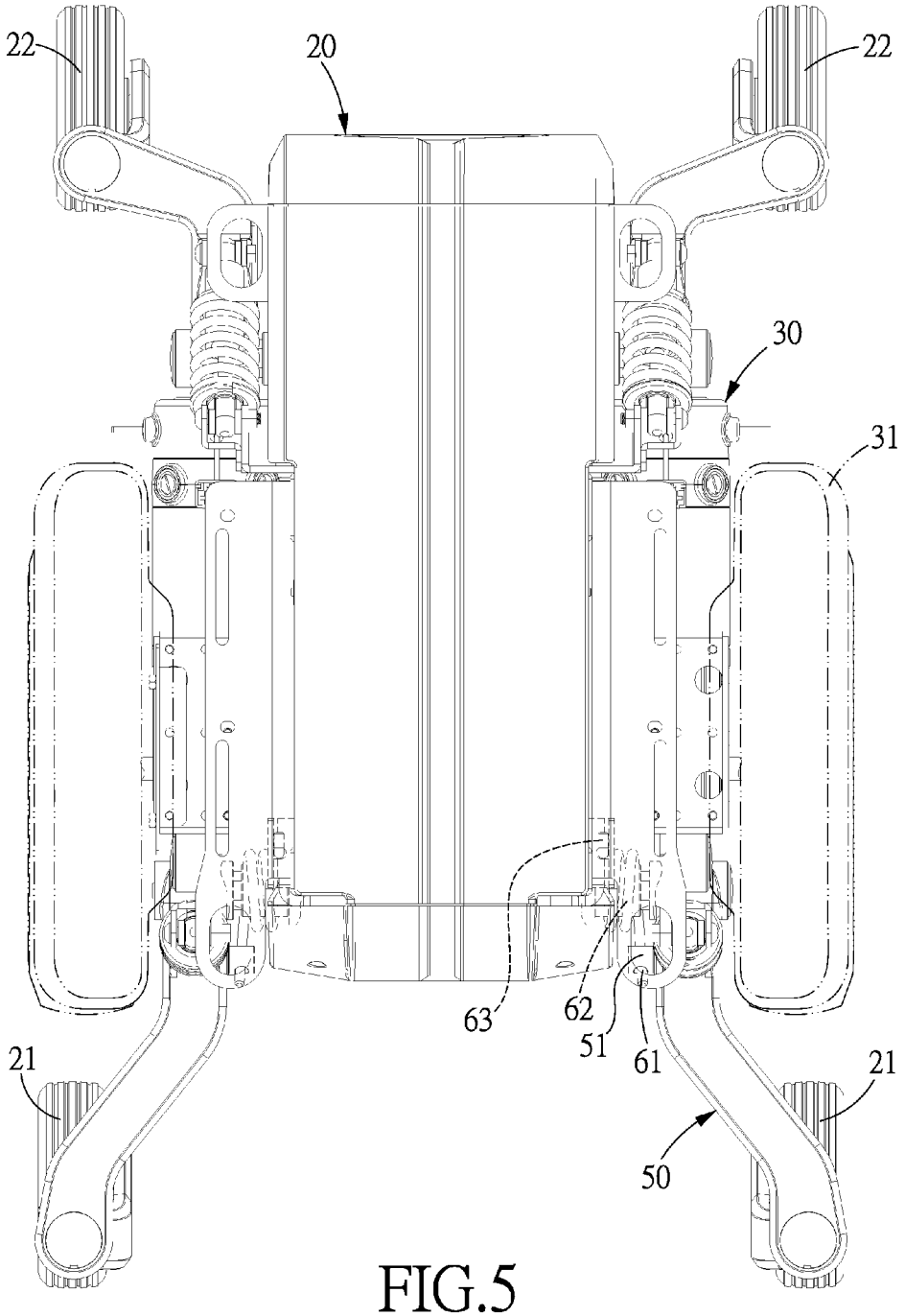
FIG. 5 is a top view of the front suspension system for an electric wheelchair in accordance with the preferred embodiment of the present invention.

The present invention will be clearer from the following description when viewed together with the accompanying drawings, which show, for purpose of illustrations only, the preferred embodiment in accordance with the present invention.

Referring to FIGS. 3-10, a front suspension system for an electric wheelchair in accordance with a preferred embodiment of the present invention is to be assembled onto a frame 20 of the electric wheelchair. On the frame 20 is disposed a seat A. At two ends of the frame 20 are disposed two front wheels 21 and two rear wheels 22, respectively. To each of two sides between the two ends of the frame 20 is pivotally fixed an assembling frame 24 via a pivot 23. A drive unit 30 is fixed to each of the assembling frames 24 and located at one side of the corresponding pivot 23, and to each of the drive units 30 is fixed a drive wheel 31. Each of the front wheels 21 is connected to the frame 20 via a front suspension system, and on the frame 20 is further fixed an abutting member 25.

The front suspension system comprises: a front pivot shaft 40, a front wheel retainer 50, an elasticity resistance member 60, and a front shock absorber 70.

The front pivot shaft 40 has one end fixed to the frame 20.

The front wheel retainer 50 includes a first section 52, a second section 53, and a third section 54 which are connected sequentially with one another. The first section 52 has one end pivoted to another end of the front pivot shaft 40 and has another end coupled to one end of the second section 53 which has another end coupled to one end of the third section 54, and the third section 54 has another end connected to the front wheels 21. An extending direction of the first section 52 is defined as a second direction D2 which is perpendicular to a first direction D1, an extending direction of the second section 53 defines an angle with respect to the first and second direction D1, D2, respectively, and the third section 54 extends along the second direction D2. A surface of the front wheel retainer 50 facing the frame 20 is formed with a driving portion 51. The front pivot shaft 40 is located lower in the first direction D1 than the abutting member 25.

The elasticity resistance member 60 is sequentially provided with a driving section 61, an elasticity resistance section 62, and a stop section 63. The elasticity resistance section 62 is a spiral structure, and the driving section 61 and the stop section 63 are connected to two ends of the elasticity resistance section 62, respectively, and extend in two different directions. The stop section 63 includes an extending portion 631 and a force applying portion 632. The extending portion 631 extends in the first direction D1, and the force applying portion 632 extends in the second direction D2. The elasticity resistance member 60 is sleeved onto the front pivot shaft 40 and located between the frame 20 and the front wheel retainer 50. The driving section 61 of the elasticity resistance member 60 is connected to the driving portion 51 of the front wheel retainer 50. In this embodiment, the driving portion 51 is formed with a through hole 511 in which is inserted the driving section 61, and the force applying portion 632 of the stop section 63 is stopped against the abutting member 25.

The front shock absorber 70 has one end pivoted to the first section 52 of the front wheel retainer 50, and has another end pivoted to another side of the pivot 23 of the assembling frame 24. The axis of the front shock absorber 70 is located at angle θ ranging from 1-10 degrees with respect to the first direction D1. In this embodiment, the angle θ is 4-6 degrees, and preferably 4 degrees, so that the front shock absorber 70 is disposed at one end of the assembling frame 24 and inclined toward the rear wheels 22.

Figure 6:
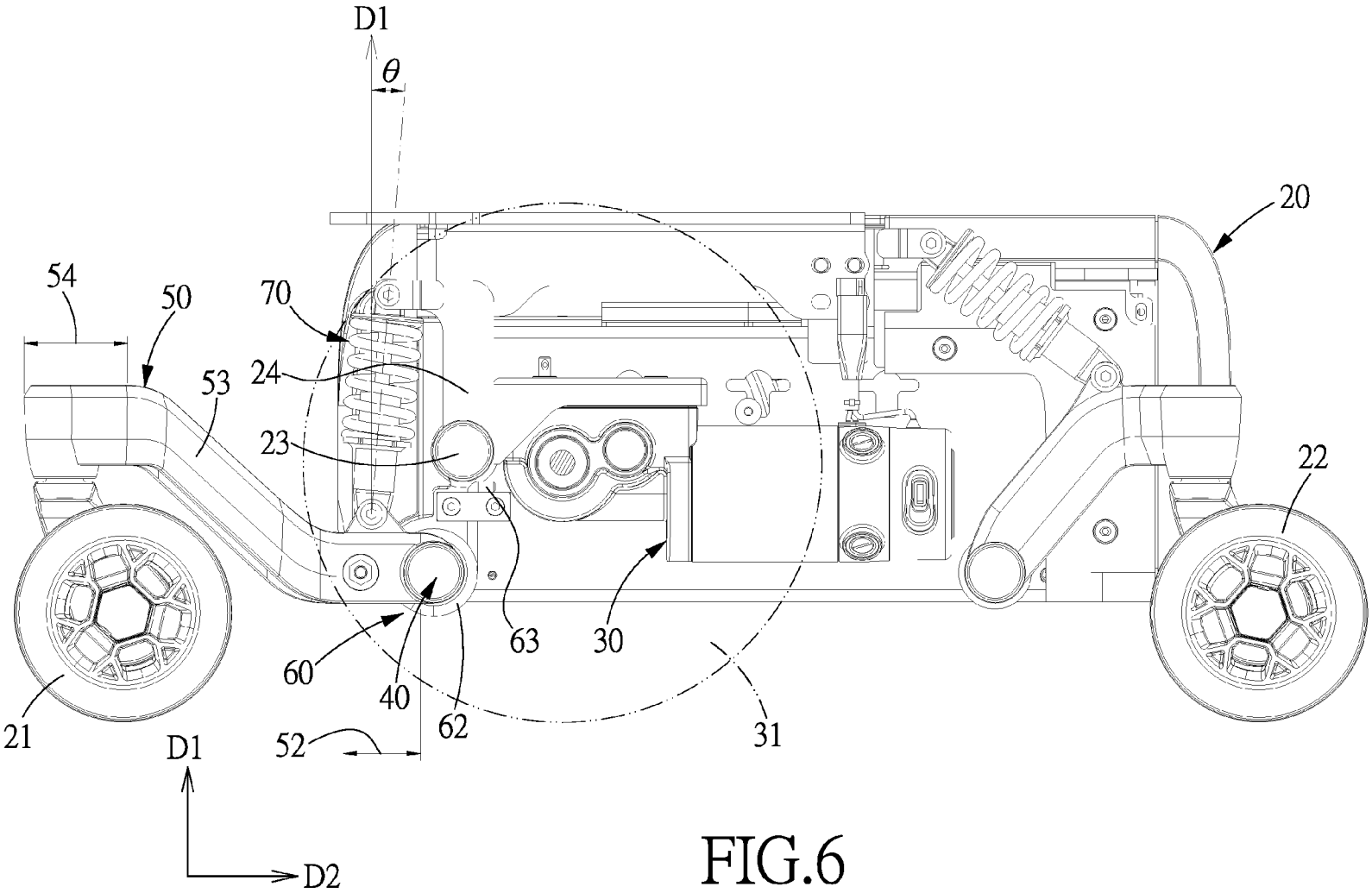
FIG. 6 is a side view of the front suspension system for an electric wheelchair in accordance with the preferred embodiment of the present invention.
Figure 7:
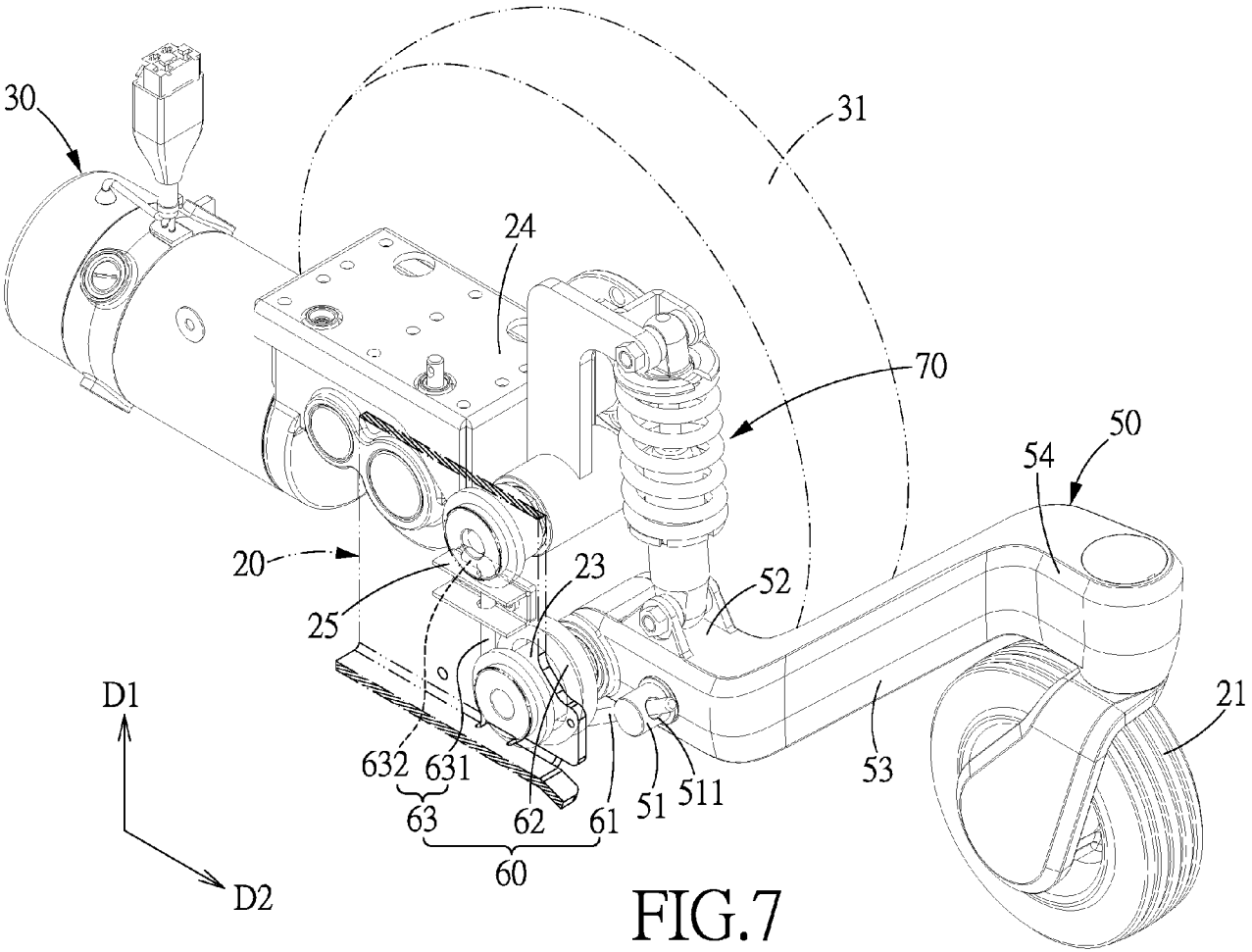
FIG. 7 is a perspective view of a part of the front suspension system for an electric wheelchair in accordance with the preferred embodiment of the present invention.
Figure 8:
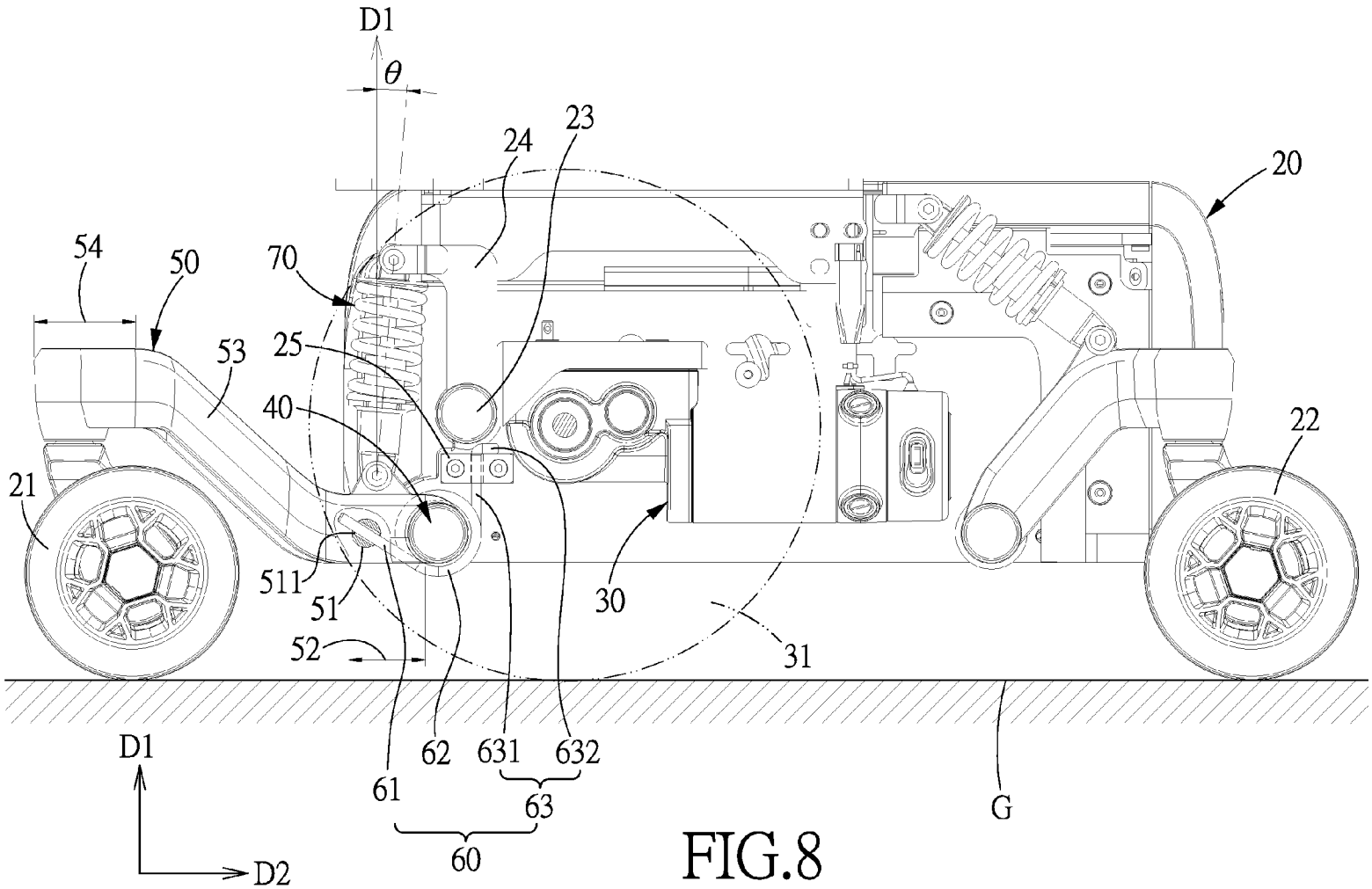
FIG. 8 is an illustrative view showing that a wheelchair equipped with the front suspension system of the preferred embodiment of the present invention is placed on a flat bearing surface.

As shown in FIGS. 6 and 8, when the frame 20 of a wheelchair equipped with the front suspension system of the present invention is placed on a flat bearing surface G which is parallel to the second direction D2, the drive wheels 31, front wheels 21 and the rear wheels 22 are flatly abutted against the flat bearing surface G.

Figure 9:
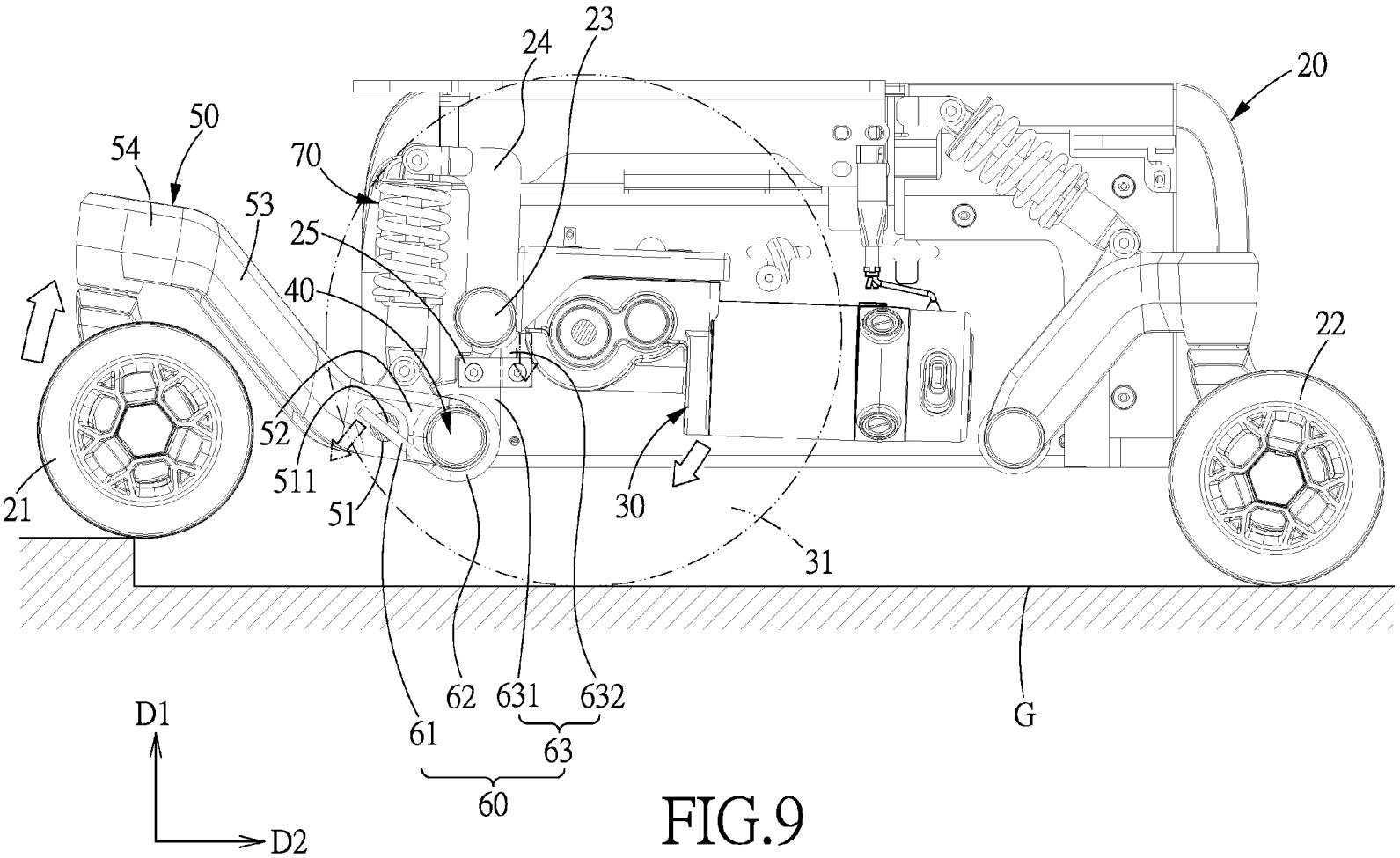
FIG. 9 is an illustrative view showing that a wheelchair equipped with the front suspension system of the preferred embodiment of the present invention encounters an upraised obstacle.

When the frame 20 encounters a raised obstacle, as shown in FIG. 9, the drive wheels 31 drive the frame 20 to move forward, the front wheels 21 will come into contact with the raised obstacle before other parts of the wheelchair. The driving force of the drive wheels 31 drives the front wheels 21 and the front wheel retainers 50 to pivot upward around the front pivot shaft 40, making the front wheels 21 move up onto the obstacle. Since the front wheel retainer 50 has the first section 52 pivoted to the front pivot shaft 40, the front shock absorber 70 is disposed on the first section 52, and the first section 52 extends in the second direction D2, the initial position of the pivoting of the front wheel retainer 50 will start from the first section 52. Besides, the pivoting angle of the front wheel retainer 50 is restricted by (or between) the horizontal first section 52 and the front shock absorber 70 which is inclined towards the rear wheels 22. As a result, when the electric wheelchair is placed on the horizontal flat bearing surface G, the pivoting angle of the first section 52 is restricted between the horizontal position and the front shock absorber 70 and will therefore be larger than 90 degrees, thus substantially improving the climbing capability (the height that the front wheels 21 can climb) of the front wheels 21.

When the front pivot shaft 40 is pivoting upward, the front wheel retainer 50 will move and cause movement of the driving section 61 of the elasticity resistance member 60 which is fixed to the driving portion 51. When the front wheel retainer 50 pivots upward, the driving section 61 will compress the elasticity resistance section 62 of the elasticity resistance member 60 to make the driving section 61 produce a downward pressing force toward the front wheel retainer 50, and make the stop section 63 produce a downward pressing force toward the abutting member 25 of the frame 20. Although the front wheels 21 have moved up onto the obstacle, the elasticity resistance member 60 will produce a downward pressing force toward the front wheel retainer 50 and the abutting member 25 of the frame 20, respectively, so that the front wheel retainer 50 is pressed down to keep pressing against the flat bearing surface G, and the frame 20 is also pressed downward to prevent tipping backward. Therefore, the gripping ability of the frame 20 is enhanced, and the safety of the wheelchair is accordingly improved.

The upward pivoting motion of the front wheel retainer 50 also causes compression of the front shock absorber 70, which consequently causes the upward pivoting of one side of the assembling frame 24 fixed to the front shock absorber 70, and causes another side of the assembling frame 24 to pivot downward around the pivot 23. Hence, the upward pivoting motion of the front wheel retainer 50 can be counteracted by compression of the front shock absorber 70 and the downward pivoting motion of the assembling frame 24, namely, the force making the front wheel retainers 50 continuously pivot upward is counteracted, thus preventing the frame 20 from tipping backward.

Figure 10:
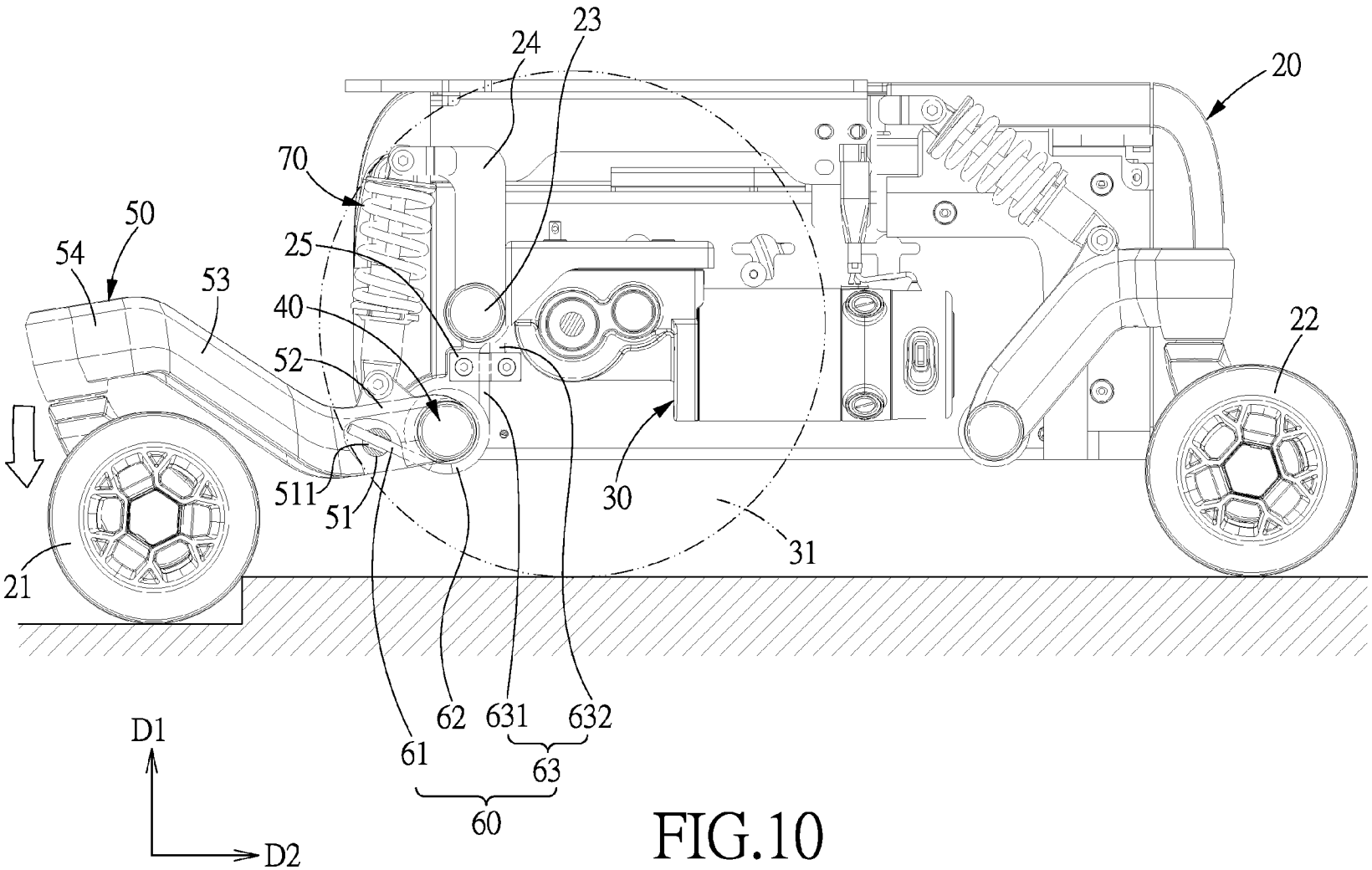
FIG. 10 is an illustrative view showing that a wheelchair equipped with the front suspension system of the preferred embodiment of the present invention encounters a sunken obstacle.

When the frame 20 encounters a sunken obstacle, as shown in FIG. 10, the drive wheels 31 drive the frame 20 to move forward, the front wheels 21 will come into contact with the sunken obstacle first. When the front wheels 21 move down to the sunken obstacle and are located at a different level with respect to the drive wheels 31 and the rear wheels 22, the front shock absorber 70 will be stretched to maintain the frame 20, the drive wheels 31 and the rear wheels 22 at their original height, so as to stabilize the wheelchair.

When each of the front wheels 21 moves down to the sunken obstacle, the corresponding front wheel retainer 50 will pivot downward around the front pivot shaft 40 to compress the driving section 61 of the elasticity resistance member 60. As a result, the elasticity resistance member 60 will produce a reaction force toward the frame 20 and the front wheel retainer 50, thus making the front wheels 21 keep pressing against the surface of the sunken obstacle, and preventing the frame 20 from tipping backward. By such arrangements, the ground gripping performance of the wheelchair of the present invention is enhanced, the possibility of tipping backward when moving on a bumpy road is substantially reduced, and safety is also improved accordingly.

It is understood from the above description that arranging the front shock absorber 70 on the horizontal first section 52 can improve upward pivoting capability of the front wheel retainer 50, which consequently increases the climbing capability of the wheelchair. Besides, when the front wheel retainer 50 and the front wheels 21 encounter a bumpy road, the elasticity resistance member 60 can produce reaction forces to prevent the frame 20 from tipping over, so as to improve safety of the wheelchair. Besides, the front shock absorber 70 can also slow down the up and down motion of the frame 20, so as to improve the riding comfort.

While we have shown and described various embodiments in accordance with the present invention, it is clear to those skilled in the art that further embodiments may be made without departing from the scope of the present invention.

What is claimed is:

1. A front suspension system for an electric wheelchair, being assembled onto a frame of the electric wheelchair and provided for mounting of two front wheels which are disposed at one end of the frame, at another end of the frame being provided two rear wheels, to each of two sides between the two ends of the frame being pivotally fixed one end of an assembling frame via a pivot, the front suspension system comprising a front pivot shaft, a front wheel retainer, an elasticity resistance member, and a front shock absorber, wherein the front pivot shaft has one end fixed to the frame, and the front wheel retainer has two ends fixed to the front pivot shaft and the front wheels, respectively, the front suspension system being characterized in that:

an abutting member is on the frame;

a surface of the front wheel retainer facing the frame is formed with a driving portion, the front wheel retainer includes a first section, a second section, and a third section which are connected sequentially with one another, an extending direction of the first section is defined as a second direction which is perpendicular to a first direction, an extending direction of the second section defines an angle with respect to the first and second direction, respectively;

the elasticity resistance member is disposed between the frame and the front wheels retainer and is sequentially provided with a driving section, an elasticity resistance section and a stop section, the elasticity resistance section is a spiral structure, and the driving section and the stop section are connected to two ends of the elasticity resistance section, respectively, and extend in two different directions, the elasticity resistance member is sleeved onto the front pivot shaft, the driving section of the elasticity resistance member is connected to the driving portion of the front wheel retainer, and the stop section is stopped against the abutting member; and the front shock absorber has one end pivoted to the first section of the front wheel retainer, and has another end pivoted to another end of the assembling frame, an axis of the front shock absorber is located at angle ranging from 0-10 degrees with respect to the first direction, and the another end of the front shock absorber fixed to the assembling frame is inclined towards the rear wheels.

2. The front suspension system for the electric wheelchair as claimed in claim 1, wherein the angle is 4-6 degrees.

3. The front suspension system for the electric wheelchair as claimed in claim 1, wherein the driving portion is formed with a through hole in which is inserted the driving section.

4. The front suspension system for the electric wheelchair as claimed in claim 1, wherein a position of the front pivot shaft on the frame in a first direction is lower than a position of the seat on the frame in the first direction.

5. The front suspension system for the electric wheelchair as claimed in claim 1, wherein the stop section includes an extending portion and a force applying portion, the extending portion extends in the first direction, the force applying portion extends in the second direction, and the force applying portion of the stop section is stopped against the abutting member.

* * * * *